United States Patent [19]

Baron et al.

[11] 4,089,659

[45] May 16, 1978

[54] PROCESS FOR PRODUCING A LEAN GAS BY THE GASIFICATION OF A FUEL MAINLY IN LUMP FORM

[75] Inventors: Gerhard Baron, Hofheim; Paul Rudolph, Bad Homburg; Rudolf Kohlen, Wehrheim; Carl Hafke, Frankfurt am Main, all of Germany

[73] Assignee: Metallgesellschaft Aktiengesellschaft, Frankfurt am Main, Germany

[21] Appl. No.: 771,724

[22] Filed: Feb. 24, 1977

[30] Foreign Application Priority Data

Feb. 26, 1976 Germany ..... 2607744

[51] Int. Cl.[2] ..... C10J 1/06

[52] U.S. Cl. ..... 48/197 R; 48/202; 48/206

[58] Field of Search ..... 48/68, 67, 66, 73, 76, 48/77, 63, 99, 105, 107, 202, 197 R, 206

[56] References Cited

U.S. PATENT DOCUMENTS

| | | | |
|---|---|---|---|
| 3,540,867 | 11/1970 | Baron et al. | 48/197 R |
| 3,866,411 | 2/1975 | Marion et al. | 48/215 |
| 3,868,817 | 3/1975 | Marion et al. | 48/215 |
| 3,993,583 | 11/1976 | Seglin | 48/197 R |
| 4,014,664 | 3/1977 | Kupfer et al. | 48/68 |
| 4,025,318 | 5/1977 | Moody et al. | 48/197 R |
| 4,031,030 | 6/1977 | Rudolph | 48/202 |

*Primary Examiner*—Richard V. Fisher
*Assistant Examiner*—George C. Yeung
*Attorney, Agent, or Firm*—Burgess, Dinklage & Sprung

[57] ABSTRACT

A process for producing lean gases in which solid fuels are gasified under superatmospheric pressure by a treatment with free oxygen-containing gases, water vapor, and other gasifying agents. In the process, fuel and gasifying agent are caused to flow in opposite directions, about 1.5 to 3.5 kg of water vapor are added per standard $m^3$ of free oxygen in the gasifying agent, about 70% of the lump coal to be gasified has a particle size from above 2 mm to about 30 mm and the remaining coal has a particle size below about 2 mm. The ballast content, consisting of water and ash, amounts to at least about 15% by weight, most of the mineral constituents have a particle size of about 2 to 30 mm and the ash which becomes available in the gasification process is withdrawn from the reactor shaft at temperatures above about 250° C. Raw gas is withdrawn at temperatures above about 350° C, coal is reacted in a water-cooled, double-walled reactor chamber and the resulting jacket steam is used to cool the grate and as a reactant. The rate at which steam consisting of extraneous steam and jacket steam is added to the gasifying agent is so adjusted in the above-mentioned range of about 1.5 to 3.5 kg per standard $m^3$ of oxygen, that the nitrogen content of the dry raw product gas does not exceed about 50% by volume.

20 Claims, 1 Drawing Figure

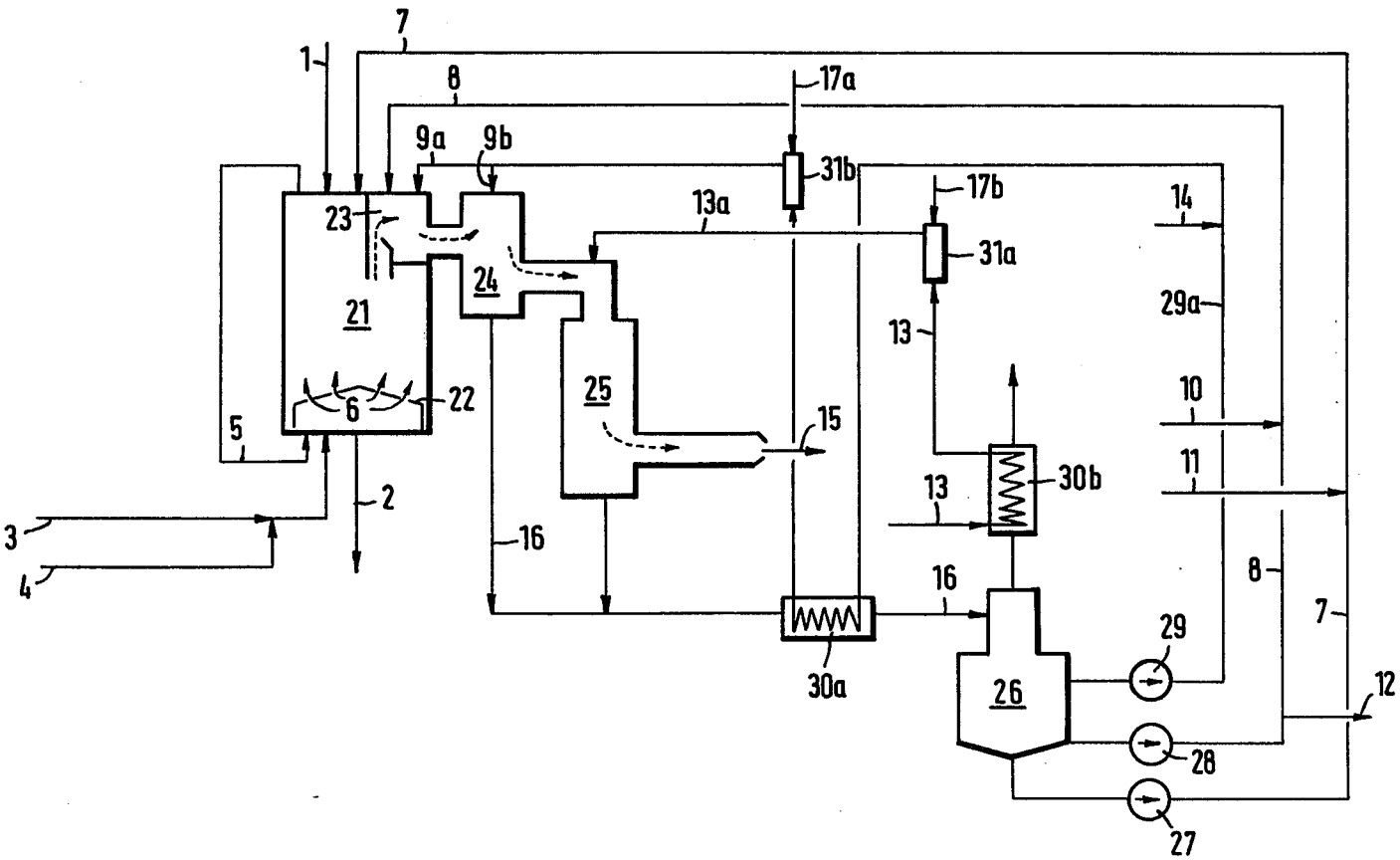
1
2
3
4
5
6
7
8
9a
9b
10
11
12
13
13a
14
15
16
17a
17b
21
22
23
24
25
26
27
28
29
29a
30a
30b
31a
31b

PROCESS FOR PRODUCING A LEAN GAS BY THE GASIFICATION OF A FUEL MAINLY IN LUMP FORM

BACKGROUND OF THE INVENTION

This invention relates to a process of gasifying fuel which is mainly in the form of lumps under a pressure of about 5 to 150 bars in a water-cooled double-walled reactor chamber, which is provided at its upper end with a feeder for the fuel to be gasified and at its lower end with a rotary grate, through which the incombustible residue of the fuel, the so-called ash, is withdrawn from the reaction chamber and the gasifying agent consisting of free oxygen-containing gases as well as water vapor and/or carbon dioxide is distributed over the cross-section of the shaft and in this distribution is fed into the reactor chamber to flow therein opposite to the coal or other solid fuel, whereas the product gas, which contains water vapor, hydrocarbons, and dust, is withdrawn from the upper portion of the reactor at a temperature between about 350° and 800° C, and the ash is removed from the reactor chamber at a temperature above about 250° C through the rotary grate. The feeding of the solid material and the discharge of the incombustible residue into and out of spaces which are under superatmospheric pressure are effected through known lock chambers.

It has been known for decades that solid fuels such as hard coal, brown coal and peat, can be gasified under superatmospheric pressure. Details of the process have been described, e.g., in the U.S. Pat. No. 2,667,409;

German Pat. No. 1,021,116, and German specifications DOS Nos. 2,346,833; 2,351,963; and 2,353,241. Gasification reactors of this kind are known in the art as LURGI Pressure Gas Producers. The gasification of solid fuels under superatmospheric pressure on a large scale in a process which has proved satisfactory is gaining in importance in view of an increasing shortage of energy resources, particularly as far as liquid and gaseous fuel reserves are concerned. Because the gas produced by a treatment of solid fuel with gasifying agents consisting of technically pure oxygen and water vapor consists in a considerable part of hydrogen, carbon oxides and methane, it can be used as a starting product for various syntheses. A mixture of free oxygen-containing gases, such as air or oxygen-enriched air, and superheated steam, can be used for a treatment by which so-called lean or dilute gases having a relatively low heating value of about 1200 to 2000 kcal per standard $m^3$ of dry gas can be produced. Such gases are particularly suitable as fuel for heating plants and for power plants, e.g., combined gas turbine-steam turbine power plants.

SUMMARY OF THE INVENTION

It is thus an object of the invention to define combined operating conditions under which lean gas can be produced by a gasification process which is substantially free of trouble and adaptable as regards the production rate.

This object is accomplished in accordance with the invention in that fuel and gasifying agents are caused to flow in opposite directions, about 1.5 to 3.5 kg of water vapor are added per standard $m^3$ of free oxygen in the gasifying agent, about 70% of the lump coal to be gasified has a particle size from above about 2 mm to about 30 mm, the remaining coal has a particle size below about 2 mm, the ballast content, consisting of water and ash, amounts to at least about 15% by weight, most of the mineral constituents (extraneous ash) have a particle size of about 2 to 30 mm, the ash which becomes available in the gasification process is withdrawn from the reactor shaft at temperatures above about 250° C, raw gas is withdrawn at temperatures above about 350° C, coal is reacted in a water-cooled, double-walled reactor chamber, the resulting jacket steam is used to cool the grate and as a reactant, and the rate at which steam consisting of extraneous steam and jacket steam is added to the gasifying agent is so adjusted in the above-mentioned range of about 1.5 to 3.5 kg per standard $m^3$ of oxygen that the nitrogen content of the dry raw product gas does not exceed 50% by volume.

If the coal to be gasified contains less nongasifiable mineral substances, e.g., less than about 10% by weight of such substances, ash which has been discharged from the reactor may be recycled into the reactor shaft and for this purpose may be admixed with the coal.

In the reactor chamber of the pressure gas producer, the fuel travels through several zones. The fuel is first dried and in a devolatilization zone is subsequently degasified before entering the gasification zone, in which a major part of the endothermic reaction is performed. Finally, the remainder of the fuel is reacted to a large extent in the combustion zone with the free oxygen which is contained in the gasifying agent and an incombustible residue remains in the form of ash. Before said ash is removed from the pressure gas producer through a lock chamber, part of the sensible heat of the ash is delivered to the gasifying agent as it flows into the reactor chamber. This delivery of heat improves the thermal economy.

Experience has shown that the composition of the gasifying agent is preferably selected so that the highest combustion temperature in the reactor chamber does not exceed the melting point of the ash.

In addition to difficultly liquefiable gases, such as carbon oxides, hydrogen, methane, and nitrogen, the raw gas produced by a gasification of solid fuels under superatmospheric pressure contains mainly water vapor.

The nitrogen content depends mainly on the concentration of the oxygen which has been admixed with the gasifying agent and on the ratio of water vapor to oxygen. The gas has also minor contents of numerous other substances, such as condensible hydrocarbons, particularly tars having different boiling temperatures. When the raw gas is purified by a further treatment, part of these other substances are removed together with aqueous condensate, which contains not only hydrocarbons but, inter alia, phenols, fatty acids and ammonia and can be processed only at a considerable expenditure.

The lower heating values of all product gases produced in the previously erected pressure gas producer plants are in a range from about about 2000 to below about 5000 kcal per standard $m^3$.

A demand for lean gases having a lower heating value below about 2000 kcal per standard $m^3$, such as are used for a reduction of ores or directly for power production in a power plant, e.g., in a combined gas turbine-steam turbine process, has not arisen until a few years ago.

It is thus another object of the invention to produce a lean or dilute gas which is of adequate quantity as regards its combustion properties and also as regards its combustion properties and also as regards the so-called machine purity which is required, by a gasification of solid fuels under superatmospheric pressure in an economically satisfactory manner.

This is accomplished in that the free oxygen is admixed in the form of air with the gasifying agent. To ensure that the nitrogen content of the raw product gas does not exceed 50%, steam is added to the gasifying air at a rate which is in a range of about 1.5 to 6.0 kg per standard $m^3$ of free oxygen, preferably of about 1.5 to 3.5 kg per standard $m^3$ of free oxygen, and which is selected in dependence on the reactivity of the solid fuel and the melting properties of its ash.

The jacket steam, which forms part of the gasifying steam, is first conducted through cooling chambers of the grate and is thus dried and superheated before being admixed with the gasifying air. This steam also protects the grate from being overheated.

The lump fuel to be gasified should have a largest particle size of about 30 mm and about 70% of it should have a particle size above about 2 mm whereas the remainder may have a particle size below about 2 mm. The ballast content, consisting of water and ash, should amount to at least about 15% and the mineral constituents, inclusive of extraneous ash, should exceed about 10%.

The ash produced by the gasification process is suitably withdrawn at temperatures which are about 20° to 30° C above the temperature of the mixed gasifying agents. The raw product gas leaves the reactor shaft at temperatures above about 350° C.

As the raw gas is subsequently purified, it is cooled to a complete saturation with water vapor and the fine-grained to dust-like fuel and/or ash particles entrained by the raw gas leaving the reactor shaft are removed to such a degree that the purified gas has the so-called machine purity and may be used, e.g., as fuel gas to produce power in a combined gas turbine-steam turbine process. The dust content of the purified gas should be less than about 10 mg per standard $m^3$, preferably between about 1 and 4 mg per standard $m^3$. The gas can be purified to machine purity, e.g., by one or more intense scrubbing stages, the last of which is fed with rather pure water, such as decarbonized extraneous fresh water. All other scrubbing stages are fed with gas liquor which has become available in the process. If the raw gas leaves the reactor shaft at temperatures above about 500° C, the first scrubbing stage may be arranged in the fuel-free upper portion of the reactor shaft.

All surplus scrubbing fluids which have contacted the gas are discharged into a separator and are separated therein into a higher-boiling hydrocarbon-containing phase, a lower-boiling hydrocarbon-containing phase, and an aqueous phase.

It has been found that all fine-grained or dust-like fuel and ash particles entrained by the gas stream settle in the higher-boiling hydrocarbons. The lower-boiling hydrocarbons and the gas liquor are virtually free from dust.

The mixture of dust and hydrocarbons is recycled into the reactor shaft and the gas producer and is mixed there with fresh fuel and cracked and/or gasified.

The dust-free hydrocarbons may be recycled to the reactor shaft to be cracked and/or gasified therein, or may be fed as additional scrubbing fluid to a scrubbing stage, or may be subjected to further processing separately from the gas-producing process proper, e.g., in a tar-distilling unit.

Almost all gas liquor is fed as scrubbing fluid to suitable scrubbing stages.

To maintain isothermal conditions in the final scrubbing stages, the incoming scrubbing fluids, whether they consist of gas liquor or of extraneous water, must be heated before entering the scrubber at least to the saturated-steam temperature of the water vapor content of the gas. The inlet temperature of said fluids should preferably exceed the saturation temperature by as much as about 30° C. This is accomplished by a heat exchange between the gas condensates to be discharged and the scrubbing fluids with water vapor.

A small branch stream of the gas liquor in circulation, preferably about 1 to 2% thereof, is continuously withdrawn from circulation in order to prevent an enriching of undesired adjuvants, such as NaCl. This branch stream is concentrated by evaporation and the heat content of the resulting vapor is economically used. The evaporation residue may be filtered to remove the undesired crystallized substances from the process. Alternatively, this water can be injected into a furnace or can be evaporated and discharged through a chimney.

It has been found in operation that the selection of a proper steam-oxygen ratio results in a gasification with a decomposition in excess of about 65% and that in this case the gas can be saturated only if extraneous water is fed to the process. There is no need to discharge gas liquor from the process except for a removal of salt. It has also been found in operation that the proportion of hydrocarbons removed in the unit for separating the gas condensates can be increased or decreased by a change of the rate at which the hydrocarbons are recycled to the reactor chamber of the gas producer and that any surplus hydrocarbons can be withdrawn from the process for further use whereas a deficiency of hydrocarbons can be compensated by a supply of extraneous hydrocarbons, such as waste oil, molasses, and other materials, to the process in order to ensure that the hydrocarbon-dust mixture to be recycled remains pumpable.

Advantageously gasification is effected at about 10 to 80 bars, the scrubbing water is decarbonized, each fluid is preheated to a temperature 1° to 3° C above saturation temperature and condensate which becomes available as the raw gas is cooled outside the gas producer is injected into the upper portion of the gas producer.

In accordance with another feature, the pH value of the gas liquor which has become available is increased above about 8 by an addition of ammonia or ammonia-containing aqueous liquors. Surplus hydrocarbons which become available as the raw gas is cooled may be gasified by a treatment with free oxygen-containing gases and water vapor in at least one separate reactor and the resulting gas is utilized in the process, or such hydrocarbons may be hydrogenated.

It has also been found in operation that the fine-grained to dust-like components which have become available in the process and are contained in the hydrocarbon-dust mixture to be recycled can be enriched with fine-grained to dust-like extraneous materials of organic nature, such as fine coal, wood flour, carbon black, etc., in such a proportion that the mixture remains pumpable.

BRIEF DESCRIPTION OF THE DRAWING

An example of the process according to the invention is illustrated diagrammatically and by way of example in the drawing.

DETAILED DESCRIPTION OF THE PREFERRED EMBODIMENTS

A reactor 21 for a gasification of coat fed in conduit 1 is illustrated without details because the reactor is known per se. A mixed gasifying agent is fed to the reactor 21 from below through a rotary grate 22 and enters the bed of gasifiable material above the rotary grate. The mixed gasifying agent consists of air, supplied through conduit 3, extraneous water vapor, supplied through conduit 4, and water vapor which has been produced in the cooling jacket of the pressure reactor and is supplied through conduit 5. The water vapor flowing in conduit 5 may be briefly referred to as jacket steam. A mixture of tar and dust is fed through conduit 7 to the gasification zone of the reactor 21.

The product gas produced in the reactor 21 flows in the direction of the dotted-line arrows through a plurality of scrubbing stages and is scrubbed and somewhat cooled therein. In the first scrubbing stage 23, tar from conduit 8 and gas liquor from conduit **9*a* are sprayed into the product gas. In the second scrubbing stage 24, the product gas is treated with gas liquor from conduit 9*b*. A final purification is effected in the third scrubbing stage 25 by a treatment with extraneous scrubbing water from conduit 13*a*. The scrubbed product gas is conducted through conduit 15** to its further use.

Scrubbing liquids used in scrubbing stages 23 and 24 are jointly collected and together with scrubbing water used in scrubbing stage 25 are conducted in a conduit 16 to a separator 26 for the gravity separation of the mixed liquids into various components. Gas liquor, having the lowest specific gravity, is fed by a pump 29 in conduit **29*a* to a heat exchanger 30*a* and is subsequently conducted through a steam-operated heater 31*b* and then flows in separate streams through conduits 9*a* and 9*b*. The steam-operated heater 31*b* is supplied with water vapor through conduit 17*a*. NaOH from conduit 14 may be added at a metered rate to the gas liquor recycled in conduit 29*a*** if this is required for a neutralization.

By means of a pump 28, tar is removed from the separator 26 and recycled to the first scrubbing stage. Surplus tar is removed in a conduit 12.

The tar-dust mixture collecting on the bottom of the separator 26 is withdrawn in conduit 7 and recycled to the pressure gasification reactor 21 by a pump 27. Extraneous dust from conduit 11 may be admixed with this recycled tar-dust mixture, if required. A conduit 10 for supplying extraneous tar may also open into conduit 8.

The hot gases and vapors leaving the separator 26 are conducted through a heat exchanger **30*b*, in which they heat water from conduit 13. The heated water is first fed to a steam-operated heater 31*a*, which is also fed with water vapor from conduit 17*b*. The heated scrubbing water is fed through conduit 13*a* to the third scrubbing stage 25**.

The invention is further described in the following illustrative examples.

EXAMPLE 1

Using the illustrated apparatus, a pressure gasifier having a shaft diameter of 3.4 *m* operated under a pressure of 20 bars was fed through a lock chamber with coal at a rate of 12 tons per hour. This coal contained 5% by a non-gasifiable mineral constituents. 80% by weight of the coal had a particle size of 3 to 30 mm and fine particles below 3 mm amounted to 20% by weight. Dust-tar mixture was recycled to the pressure gasifier at a rate of 1000 kg/h. The pressure gasifier was fed with gasifying air at a rate of 25,000 standard $m^3$/h. The steam-air ratio amounted to 0.6 kg per standard $m^3$. The gas exit temperatures of the gasifier varied between 600° and 650° C. The gas produced by the operation had the following average analysis in % by volume:

| | |
|---|---|
| $CO_2 + H_2S$ | 15.8 |
| $O_2$ | 0.3 |
| $H_2$ | 14.4 |
| $N_2$ | 55.1 |
| CO | 11.3 |
| $CH_4$ | 2.7 |
| $C_nH_m$ | 0.4 |

The steam decomposition $\eta$ amounted to less than 45%. The quality of the resulting product gas was not sufficient for its use in a combined gas turbine-steam turbine process. As a relatively large proportion of dust was entrained by the raw gas, the dust content of the recycled tar increased rapidly to 45% so that the tar was no longer pumpable. Even though the recycled tar was diluted with extraneous tar, the gasifier had to be shut down after a few days of operation.

EXAMPLE 2

The same gas producer was used and was operated under the same conditions as in Example 1. The coal to be gasified came from the same seam. Its content of non-gasifiable mineral constituents exceeded 20% by weight. 70% by weight of this coal had a particle size of 3 to 30 mm, and the fine particles below 3 mm amounted to 30% by weight. For this reason the pressure gasifier was fed with coal to be gasified at the same rate of 12 tons per hour but the dust-tar mixture was recycled only at a rate of 800 kg/h. Gasifying air was supplied at the same rate, and the steam-air ratio amounted to only 0.35 kg per standard $m^3$. The gas exit temperatures of the gasifier were generally lower and varied between 520 and 550° C. The gas produced by this operation had the following average analysis in % by volume:

| | |
|---|---|
| $CO_2 + H_2S$ | 14.4 |
| $O_2$ | 0.0 |
| $H_2$ | 22.7 |
| $N_2$ | 41.0 |
| CO | 17.1 |
| $CH_4$ | 4.2 |
| $C_nH_m$ | 0.6 |

The analysis of the gas produced in Example 2 exhibits a desirable increase of the combustible components of the gas so that the product gas had a higher heating value. The steam decomposition $\eta$ increased above 60%. As less dust was entrained by the raw gas, the recycled tar did not contain more than 30% dust and remained pumpable without being diluted. The gasification operation could be continued for several months. Throughout that time, the resulting product was successfully used in a combined gas turbine-steam turbine process.

It will be appreciated that the instant specification and example are set forth by way of illustration and not limitation, and that various modifications and changes may be made without departing from the spirit and scope of the present invention.

What is claimed is:

1. In a process for producing lean gases in which coal in the presence of mineral constituents is gasified in a reaction chamber under super-atmosphereric pressure of about 5–150 bars by a treatment with a gasifying agent containing air and water vapor, the improvement which comprises: supplying the coal plus mineral constituents and gasifying agent so as to flow in opposite directions, supporting the fuel on a grate, adding about 1.5 to 3.5 kg of water vapor per standard $m^3$ of free oxygen in the gasifying agent, about 70% of the coal to be gasified having a particle size from above about 2 mm to about 30 mm and the remaining coal having a particle size below about 2 mm, the ballast content of water and ash amounting to at least about 15% by weight, most of the mineral constituents having a particle size of about 2 to 30 mm, withdrawing the ash which becomes available in the gasification process from the lower portion of the reactor chamber at a temperature above about 250° C, withdrawing raw gas at temperatures above about 350° C, cooling the reactor chamber with water in a water-cooled, double-walled jacket thereby generating steam from the cooling water, cooling the grate with such steam and supplying such steam to said chamber as part of the gasifying agent, adjusting the rate at which steam consisting of extraneous steam and jacket steam is added to the gasifying agent within the above-mentioned range of about 1.5 to 3.5 kg per standard $m^3$ of oxygen so that the nitrogen content of the dry raw product gas is from about 25 to 50% by volume, and scrubbing said raw gas product to reduce its dust content to less than about 10 mg per standard $m^3$.

2. A process according to claim 1, wherein ash which has become available in the gasification process is recycled to provide for a mineral ballast content of 15 to 25% by weight in the fuel feed.

3. A process according to claim 1 wherein the product gas is scrubbed in at least one scrubbing stage with gas liquor that has been produced in the process, the product gas is fully saturated with water vapor as it leaves the first scrubbing state and is scrubbed in any subsequent scrubbing stages without a temperature drop.

4. A process according to claim 3, wherein the product gas is scrubbed in a final scrubbing stage with substantially pure water which is extraneous to the process, losses which are due to the evaporation in the first scrubbing stage are compensated by an addition of surplus water, and the dust content of the gas is decreased below about 10 mg per standard $m^3$.

5. A process according to claim 4, wherein each scrubbing fluid is preheated to the saturation temperature of the gas to be purified, before the scrubbing fluid enters the scrubber, and this preheating is effected by a heat exchange within the process.

6. A process according to claim 1, including the further step of recycling to the reactor chamber a mixture of dust and at least part of the hydrocarbons which become available as the raw gas is scrubbed.

7. A process according to claim 1, wherein the gas exit temperatures from the reactor chamber exceed about 500° C and water is injected into the upper portion of the gas producer.

8. A process according to claim 1 wherein the jacket steam which becomes available during the gasification process is used to cool those parts of the grate which are subjected to the highest thermal and mechanical stresses and is subsequently used as a gasifying agent.

9. A process according to claim 1, wherein the lean product gas is purified and then used directly to produce power.

10. A process according to claim 1, wherein the lean product gas is purified and then used in a combined gas turbine-steam turbine process.

11. A process according to claim 1, wherein the lean product gas is purified and then used in a multi-stage gas turbine process.

12. A process according to claim 1, wherein gas liquor, which becomes available as the raw gas is cooled, is concentrated by evaporation and the heat content of the resulting vapor is utilized for the gasification.

13. A process according to claim 12, wherein the evaporation residue is filtered for the removal of crystallized salts.

14. A process according to claim 1, wherein the pH value of the gas liquor which has become available is increased above about 8 by an addition of ammonia or ammonia-containing aqueous liquors.

15. A process according to claim 1, wherein vapors which become available in the process are added to the gasifying agent so that they are reacted in the gas producer.

16. A process according to claim 1, wherein surplus hydrocarbons which become available as the raw gas is cooled are gasified by a treatment with free oxygen-containing gases and water vapor in at least one separate reactor and the resulting gas is utilized in the process.

17. A process according to claim 16, wherein the hydrocarbons which become available as the raw gas is cooled are hydrogenated.

18. A process according to claim 1, wherein less tar is produced than is required for a pumpable mixture and hydrocarbons extraneous to the process are added to the tar-dust mixture to be recycled.

19. A process according to claim 18, wherein the tar-dust mixture is enriched to the pumpability limit with fine-grained to dust-like organic material which is supplied from an external source.

20. A process according to claim 4, wherein the solid fuel is gasified under a pressure of about 10 to 80 bars, the scrubbing water is decarbonized water, each scrubbing fluid is preheated to a temperature 1° to 3° C above saturation temperature and condensate which becomes available as the gas is cooled outside the gas producer is injected into the upper portion of the gas producer.

* * * * *

UNITED STATES PATENT AND TRADEMARK OFFICE

CERTIFICATE OF CORRECTION

PATENT NO. : 4,089,659

DATED : May 16, 1978

INVENTOR(S) : Baron et al

It is certified that error appears in the above-identified patent and that said Letters Patent are hereby corrected as shown below:

| | |
|---|---|
| Col. 3, line 61 | Delete "and" (first occurrence) and substitute--of--. |
| Col. 5, line 4 | Delete "coat" and substitute--coal--. |
| Col. 5, line 63 | Before "operated" insert--and--. |
| Col. 8, line 58 | Before "gas" (first occurrence) insert--raw--. |

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*